US006887171B2

(12) United States Patent
Hochfeld

(10) Patent No.: US 6,887,171 B2
(45) Date of Patent: May 3, 2005

(54) BASKETBALL-TYPE GAME AND APPARATUS FOR PLAYING THE SAME

(75) Inventor: Alan Hochfeld, Holbrook, NY (US)

(73) Assignee: Leonard Holtz, New York, NY (US); partial interest ( * ) Notice: Subject to any disclaimer, the term of this patent is extended or adjusted under 35 U.S.C. 154(b) by 0 days.

(21) Appl. No.: 10/430,003

(22) Filed: May 5, 2003

(65) Prior Publication Data

US 2004/0224794 A1 Nov. 11, 2004

(51) Int. Cl.[7] ..... A63B 67/00
(52) U.S. Cl. ..... 473/470; 273/348
(58) Field of Search ..... 473/470–472, 473/465, 505, 509, 426, 439; 273/343, 334, 335, 398, 400–402, 407, 348; 124/8, 16

(56) References Cited

U.S. PATENT DOCUMENTS 1,954,838 A * 4/1934 Woolsey et al. ..... 273/317.5
1,958,892 A * 5/1934 Hill ..... 273/357
3,069,805 A * 12/1962 Burrows ..... 446/124
4,656,398 A * 4/1987 Michael et al. ..... 315/293
4,863,174 A * 9/1989 Cummings ..... 473/509
4,900,036 A 2/1990 Morgan
5,924,940 A * 7/1999 Lucy, Jr. ..... 473/414
6,537,163 B2 * 3/2003 Hicks ..... 473/509

* cited by examiner

*Primary Examiner*—Sebastiano Passaniti
*Assistant Examiner*—M. Chambers
(74) *Attorney, Agent, or Firm*—Frishauf, Holtz, Goodman & Chick, P.C.

(57) ABSTRACT

Apparatus for a game to be played with a ball including a basket assembly adapted to be mounted to a ceiling or other elevated horizontal surface and defining at least two openings at a bottom thereof receivable of the ball. The basket assembly defines an interior space adjacent and above the openings such that the ball enters into the interior space of the basket assembly when passing in an upward direction through the openings. The interior space in the basket assembly adjacent to and above each opening constitutes a basket. Points are scored upon the passage of the ball through one of the openings into a basket. If the openings are connected to one another, then points can be scored when the ball passes into one basket and through the interior space of the basket assembly to the other basket.

26 Claims, 3 Drawing Sheets

BASKETBALL-TYPE GAME AND APPARATUS FOR PLAYING THE SAME

FIELD OF THE INVENTION

This invention relates to a basketball-type game, and more particularly to a basketball game in which players lie head-to-head on a flat surface facing upward and shoot a ball in an upward vertical direction into a basket.

This invention also relates to a basket assembly for use in a basketball-type game in which a ball is shot upward in a vertical direction into a basket in the basket assembly, in particular, by players lying head-to-head on a flat surface facing upward.

BACKGROUND OF THE INVENTION

Various basketball-type games are known. Generally, the known basketball games require movement of the players and could create damage when played indoors, for example to furniture and other indoor articles.

The typical basket assembly used for such games includes a flat, vertically oriented backboard mounted to a pole or suspended from a ceiling. A basketball hoop projects from the backboard and a net is suspended from the hoop.

During play, the ball is thrown by the players when in a standing position at the hoop with points being scored whenever the ball falls through the hoop.

An alternative basketball-type game is described in U.S. Pat. No. 4,900,036 which describes a curved vertically, oriented frontboard having three ball-receiving openings and supporting members which support the frontboard on a basketball backboard and hoop. The objective of the game using the frontboard is to throw the ball through one of the openings in the frontboard with the hoop playing no part in the game other than to serve as a support for the front board.

In this alternative game, the players still have to be in a standing position and move around relative to the frontboard.

OBJECTS AND SUMMARY OF THE INVENTION

An object of the present invention is to provide a new and improved basketball-type game wherein the players are located in a substantially stationary position.

A further object of the invention is to provide such a basketball-type game wherein the players lie on a horizontal surface such as a floor, face up.

Yet another object of the invention is to provide such a basketball-type game wherein the players lie on a floor, head facing up, and with the head of one player adjacent the head of another player.

Another object of the invention is to provide a basket assembly including openings (hoops) for a basketball-type game which is mounted so that points are scored whenever a ball passes through the opening into the interior of the basket assembly in an upward vertical direction.

In order to achieve these objects and others, an apparatus for a game to be played with a ball in accordance with the invention includes a basket assembly adapted to be mounted to a ceiling or other elevated horizontal surface and defining at a plurality of openings at a bottom thereof receivable of the ball, for example two or three openings. The basket assembly defines an interior space adjacent and above the openings such that the ball enters into the interior space of the basket assembly when passing in an upward direction through the openings. The interior space in the basket assembly adjacent to and above each opening constitutes a basket. Points are scored upon the passage of the ball through one of the openings into a basket.

To play a game using the basket assembly, the basket assembly is attached to the ceiling or other elevated surface, such as by hook-and-loop fasteners of the VELCRO™ type, and the players lie on a horizontal surface below the basket assembly, preferably with the head of one player in close proximity to or in contact with the head of the other player. This position is considered a head-to-head position herein. The players may lie on a floor mat designed for use with the basket assembly in that it includes markings of a traditional basketball court and markings to position the players relative to the basket assembly.

Each player is assigned one of the baskets and attempts to throw the ball into that basket to score points, and possibly through the basket depending on the construction of the basket. If the ball is thrown by one player and enters into the basket assigned to the other player, that player receives points. Play continues until either player reaches a predetermined number of points or a predetermined period of time has elapsed.

The basket assembly may take several different forms. In one embodiment, the basket assembly includes a pair of basket members having a hollow interior and each defining a respective opening at a bottom thereof. The basket members are connected to one another by a connector to provide a predetermined spacing between the openings.

In another embodiment, the basket assembly includes a generally U-shaped, unitary basket member defining the openings and an interior space adjacent to and above the openings. One opening is arranged at each end of the member such that a portion of the member adjacent each opening constitutes a basket. A mounting bracket is connected to the member and is attached to the ceiling or other elevated horizontal surface. A passage may be provided to connect the openings and a center or return opening may be provided in communication with the passage to enable removal of the ball from the interior space of the unitary member.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
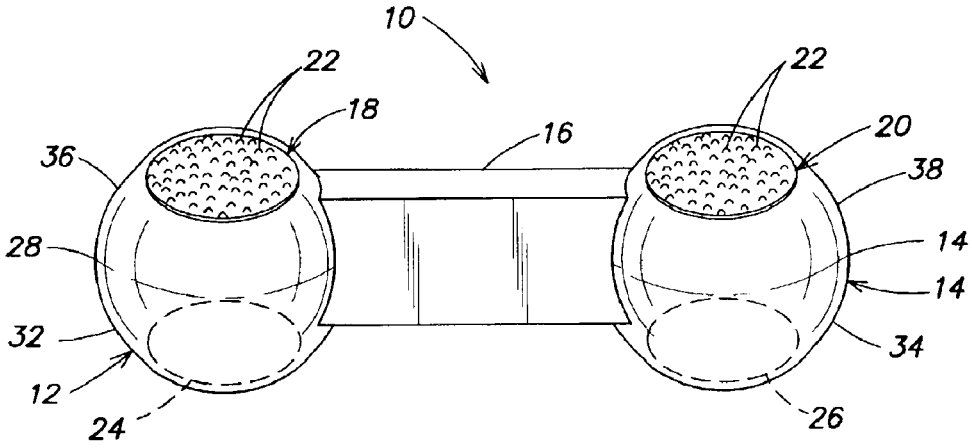
FIG. 1 is a side perspective view of a basket assembly including a pair of baskets used in the game of the present invention.
Figure 2:
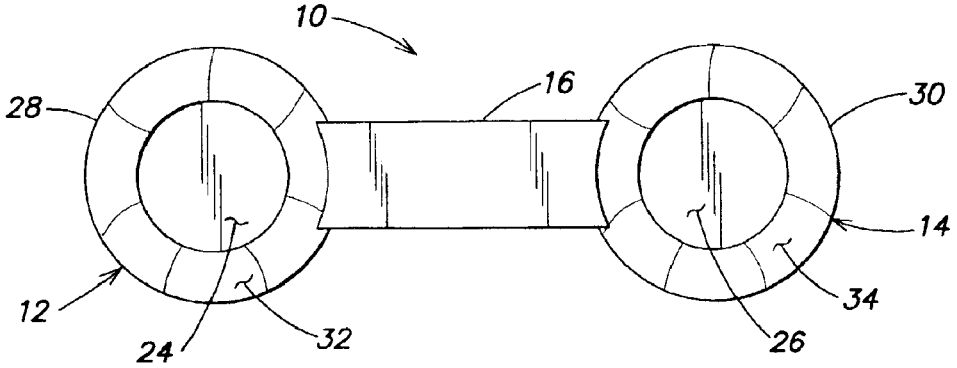
FIG. 2 is a bottom view of the basket assembly shown in FIG. 1.

Referring to FIGS. 1 and 2, a first embodiment of a basket assembly 10 used in a game in accordance with the present invention comprises first and second basket members 12, 14 and a connector 16 for connecting the first and second basket members 12, 14 together. The connector 16 as shown is elongate and the first and second basket members 12, 14 are mounted one at each end of the connector 16.

The basket members 12, 14 have a solid upper part 18, 20, respectively, with hook-and-loop fasteners 22 connected thereto, as seen in FIG. 1. The fasteners 22 at the top of the baskets 12, 14 in FIG. 1 may be female members of the hook-and-loop fastener system, in which case, the male members are adhered to the ceiling or other elevated surface (preferably, horizontal), preferably by adhesive tape. In use, the male hook-and-loop fastener members, such as of the VELCRO™ type, would be adhered to the ceiling at the position that it is wished to hang the basket assembly 10, and then the female members of the hook-and-loop fastener system are pressed against the male members on the ceiling, to mount the basket assembly 10 on the ceiling. The connector 16 maintains the baskets 12, 14 in spaced relationship.

Instead of hook-and-loop fasteners 22, other fastening devices can be used whether they provide a fixed connection between the upper part 18, 20 of the basket members 12, 14 and the ceiling or other elevated horizontal surface or a detachable connection. For example, the upper parts 18, 20 of the basket members 12, 14 could be screwed, adhered by an adhesive, riveted or nailed to the ceiling or attached using hook-and-loop fasteners such as of the VELCRO™ type. Also, it is conceivable that the connector 16 is attached to the ceiling or other elevated horizontal surface instead of the baskets 12, 14.

The baskets 12, 14 are preferably members having a circular opening 24, 26 at the bottom thereof, and an inclined outwardly center portion 28, 30 to thereby form inclined walls 32, 34 adjacent the opening 24, 26 and inclined walls 36, 38 adjacent the top 18, 20. As such, the basket members 12, 14 are upside down or opposite from the traditional baskets used in basketball-type games in that the opening is at the bottom and a receptacle is defined above the opening. Thus, to enter the basket members 12, 14, a ball must be directed upward through the opening 24, 26 and into the interior of the basket member 12, 14.

As shown in FIG. 1, the connector 16 is attached to the center portions 28, 30 of the baskets 12, 14 including a portion of each inclined wall 32, 34, 36, 38. Nevertheless, the connector 16 can be attached at other locations to the baskets 12, 14 and still provide the desired spacing effect.

In use, the basket assembly 10 is mounted to a ceiling or other elevated surface (preferably a horizontal surface) at a height to provide sufficient space between a floor below the baskets 12, 14 and the baskets 12, 14. At least one player lies on the floor below the baskets 12, 14 with his or her shoulders touching the floor and throws a ball upwardly in an attempt to throw the ball into one of the openings 24, 26. When the ball enters the opening 24, 26, it bounces around inside the basket 12, 14, in which it enters, and then fells out of the opening 24, 26. In this embodiment, the ball cannot pass between the baskets 12, 14 to fall out of the opening of the other basket in view of the interior space of each basket 12, 14 being isolated from the interior space of the other basket 12, 14.

Figure 3:
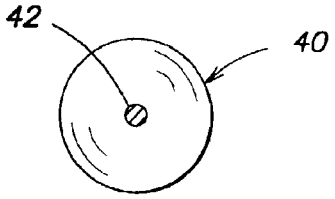
FIG. 3 shows a ball for use in the game in accordance with the invention.

The ball 40 is shown in FIG. 3 and is preferably made from a foam material, such as sponge material, so that it is lightweight and will not damage articles when it falls out of the opening 24, 26 of the respective basket 12, 14. Such sponge balls are generally known in the art, one particular commercial ball being sold under the brand name NERF™. Preferably, the ball 40 is dimensioned to be smaller than the opening 24, 26 so that after the ball 40 enters the opening 24, 26, it will engage the inclined side walls 32,34 of the baskets 12, 14, respectively, before coming out of the baskets 12, 14. By this effect, the ball 40 is retained inside the basket 12, 14 for a short period of time, to enable the player(s) to ensure that the ball 40 actually entered the basket 12, 14 so that the player who threw the ball 40 into the basket 12, 14 receives one or more points for causing the ball 40 to enter the basket 12, 14 (assuming that player was assigned that basket).

The baskets 12, 14 may be clear or opaque. Preferably, the basket 12, 14 is approximately 10 inches in height from top to bottom and the openings 24, 26 at the bottom thereof are about 5 inches in diameter. The ball 40 is preferably about 4–4.5 inches in diameter.

If the sponge ball 40 is too light, a small weight 42 may be added thereto to improve the game. The small weight 42 may be pressed into the interior of the sponge ball 40.

The connector 16 is preferably about 12 inches length, so that the two baskets 12, 14 are spaced apart by approximately 12 inches. The connector 16 and the baskets 12, 14 may all be made of plastic material, and the connector 16 may be integrally molded with the baskets 12, 14, or can be connected thereto by an adhesive, sonic welding, or the like. Alternatively, the connector 16 can be connected to the baskets 12, 14 by rivets, screws or any other connecting device.

Figure 4:
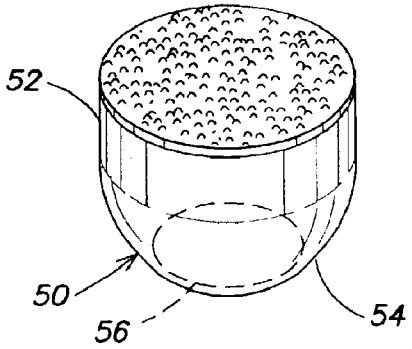
FIG. 4 shows a modified embodiment of a basket for the basket assembly shown in FIGS. 1 and 2.

FIG. 4 shows a modified arrangement of a basket 50 for use in a basket assembly and game in accordance with the invention wherein the basket 50 has an upper portion 52 which is substantially cylindrical in shape, and inclined lower walls 54 which terminate in a circular opening 56. The opening 56 is substantially the same as the openings 24, 26 discussed above with respect to FIGS. 1 and 2.

The basket 50 of FIG. 4 can be used in place of one or both of the baskets 12, 14 shown in FIGS. 1 and 2. When two such baskets are used, a connector such as connector 16 is provided to maintain the baskets in spaced apart relationship.

The connector 16 may be omitted and the baskets 12, 14 may be independently mounted to the ceiling or other elevated surface in a spaced apart relationship.

Figure 5:
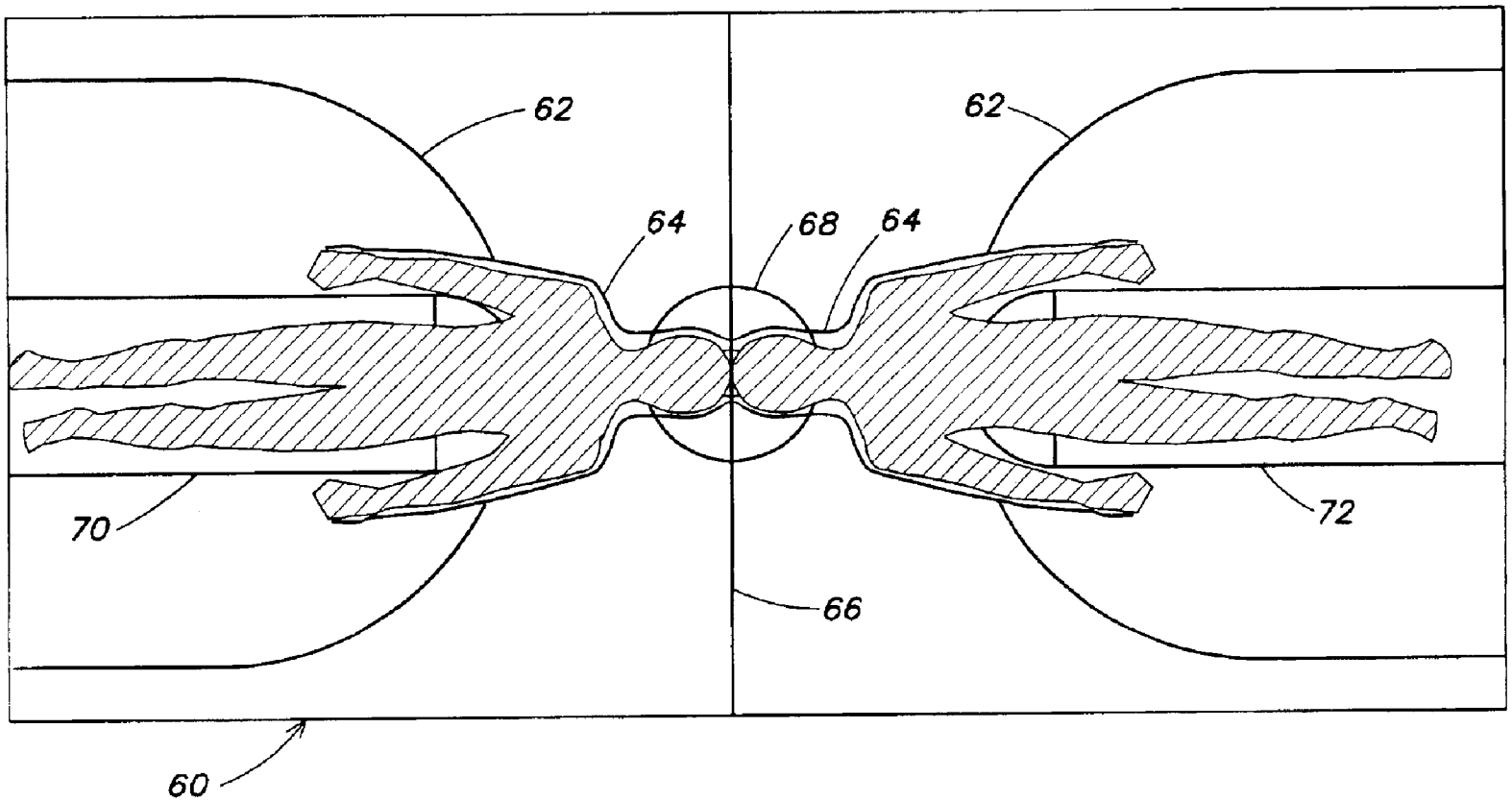
FIG. 5 shows two players lying on a floor mat in accordance with the invention, facing up so that they will be facing the basket assembly.

FIG. 5 shows a floor mat 60 for use in the present invention. The floor mat 60 has simulated basketball-type court markings 62 imprinted thereon, with markings 64 for locating the heads of the players and the bodies of the players. The center line 66 of the mat 60 is placed approximately below the center of the connector 16 so that the center line 66 is substantially equidistant from both baskets 12, 14. The players lie so that their heads are approximately within circular area 68 and their bodies are aligned with substantially rectangular areas 70, 72.

Figure 6:
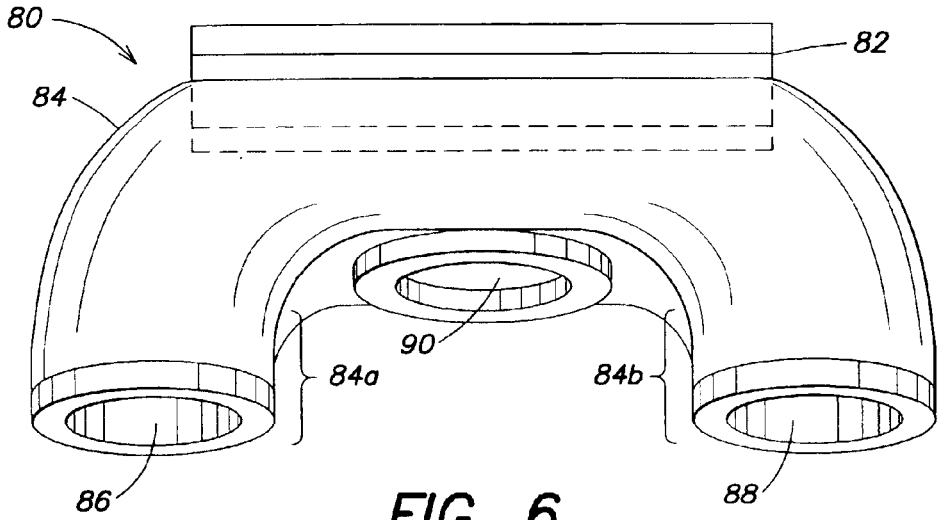
FIG. 6 is a side view of another embodiment of a basket assembly for use in the game of the present invention.
Figure 7:
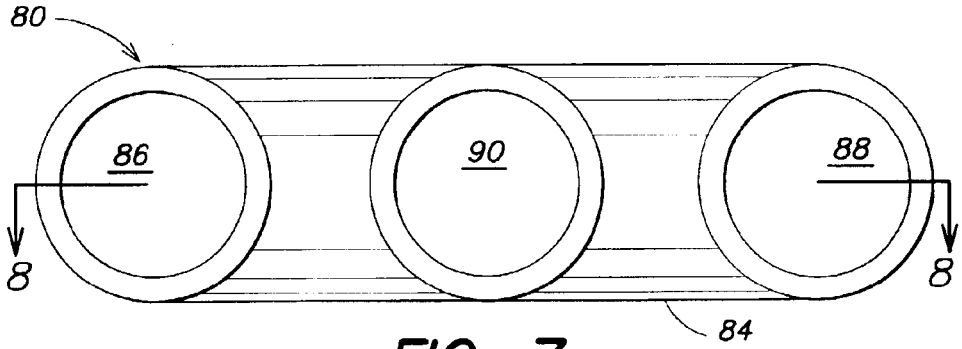
FIG. 7 is a bottom view of the basket assembly shown in FIG. 6.
Figure 8:
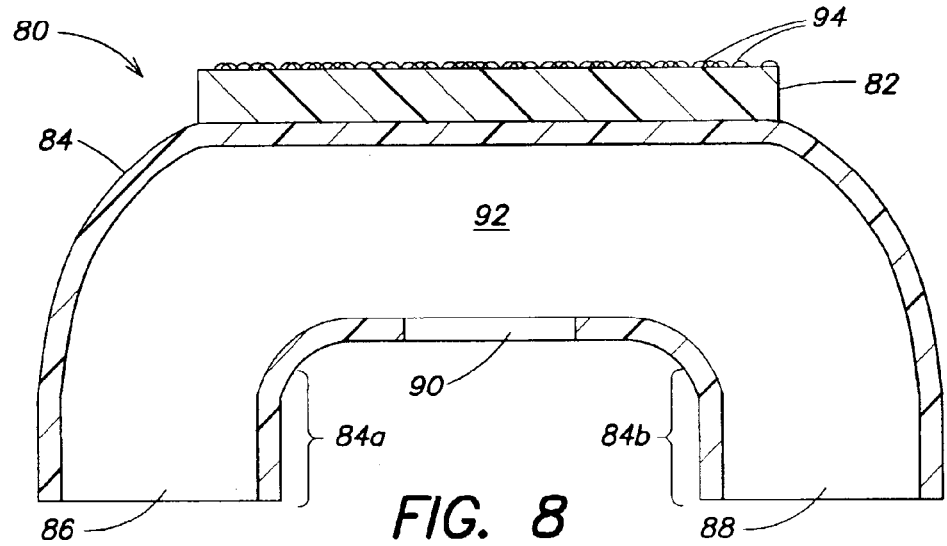
FIG. 8 is a cross-sectional view taken along the line 8—8 of FIG. 7.

Another embodiment of a basket assembly for use in a game in accordance with the invention is shown in FIGS. 6–8. In this embodiment, the basket assembly 80 includes a mounting member 82 (preferably a member with a flat top as seen in FIG. 8) and a basket member 84 attached to or formed integral with the mounting member 82. Mounting member 82 may be integrally formed with the basket member 84.

The member 84 has a U-shape with three openings 86, 88, 90. That portion 84*a* of the member 84 adjacent opening 86 at one end serves as a first basket and that portion 84*b* of the member 84 adjacent opening 88 at the opposite end serves as a second basket. A passage 92 is defined in the member 84 connecting the openings 86, 88 and communicates with the opening 90 situated between the openings 86, 88. Center opening 90 serves as a return opening through which the ball is returned after having been thrown into one of the openings 86, 88.

The mounting member 82 may be attached to a ceiling or other elevated horizontal surface by hook-and-loop fasteners (such as of the VELCRO™ type), screws, rivets, nails or adhesives, represented generally by 94 in FIG. 8. When using hook-and-loop fasteners, the male members of the hook-and-loop fastener system may be arranged on the mounting bracket 82 and the female members arranged on the ceiling or vice versa.

The member 84 may be clear or opaque. Preferably, the openings 86, 88 are about 5–10 inches in diameter. A ball which is dimensioned to be smaller than the openings 86, 88 is preferably used, e.g., one which is about 4–7 inches in diameter. The member 84 is preferably dimensioned to space the openings 86, 88 about 12 inches apart. The member 84 may be made of plastic material.

The basket portions 84*a* and 84*b* of FIG. 8 can be either shaped as shown in FIG. 8, or can take the shapes shown in FIG. 1 or 4. The member 84 is preferably made of molded plastic material, and therefore, the portions 84*a*, 84*b* can be made in substantially any desired shape, for example with the inclined surfaces 32 (FIG. 1), 54 (FIG. 4) which retain the ball in the basket for a short period of time after entry into the basket, to confirm that the ball has actually entered the basket so that the player who threw the ball into the basket receives the appropriate number of points. In all other respects, the member 84 can be as shown in FIG. 8.

The game of the present invention can be played with one player or with two or more players. When one player plays the game, the object is to improve the skill of the player. When two players participate, the object is to score more baskets than your opponent. Two players would play the game as described below.

Upside down head-to-head basketball is preferably played on the mat 60 described above, that is similar to a real basketball court, to improve the aesthetics and feelings generated during the game. The two opponents lie down flat, head-to-head, on the mat 60, with their heads in the vicinity of the circular area 68 shown in FIG. 5. The tops of the players' heads can either be touching or close to touching, or can be spaced further apart.

The basket assembly 10, 80 is mounted to the ceiling or other elevated horizontal surface at a height to provide sufficient space between the floor below the basket assembly 10, 80 and the openings 24, 26 or 86, 88. The players are positioned such that the baskets 12, 14 (in the embodiment of FIGS. 1 and 2) or the baskets 84*a*, 84*b* (in the embodiment shown in FIGS. 6–8) are arranged to be directly above the head of each respective player. In a two-player game, two baskets are provided and each basket is located above the head of each player.

The way to score is to throw the ball 40 upwardly into your assigned basket. If a player throws the ball 40 into his or her opponent's basket, the points scored will go to the opponent, just like in real basketball. A regular "shot" that goes into your basket is worth 2 points. Other point-related rules can also be in effect. For example, it could be agreed to in advance that a "shot" whereby the ball 40 goes into the basket without touching a rim defining the opening is worth 3 points.

Two possible ways of playing upside down head-to-head basketball are as follows. The first way is a non-contact method of play. While playing with this strategy, no touching of one person by another is permitted. If a player is touched by the other player, this counts as a foul and the player who is fouled gets a foul (or free or extra) shot. A foul shot is a shot where one player throws the ball 40 toward his or her basket and the other player is not permitted to throw at that time. Thus, it is an extra shot. Foul shots could be worth 1 point, as in real basketball.

In addition, since the shoulders of the player(s) must remain in contact with the floor or floor mat when present, in accordance with one set of rules, a foul can be committed if a player lifts his or her shoulders off of the floor or floor mat.

Another way to play the game is to permit contact whereby one player can block the other player's arms while taking shots. It could be agreed upon in advance that certain types of "blocking" is not permitted, and will result in a foul shot by the other person. Before the game begins, the players decide which way to play the game; that is, a contact game or a non-contact game.

Rebounding, as it is a very important part of basketball, is also very important in this game. As the ball 40 comes down from a missed shot, it is up for grabs. Either of the two players can rebound or catch the ball 40 after any missed shot. It does not matter who shot the ball 40 last.

Full arm extension is allowed on a 360° circle in order to grab or rebound a ball.

In the embodiment of FIGS. 1 and 2, after a shot is made, the ball is taken out of the basket 12, 14 if it has not already fallen out. Thus, once a successful basket is made, the person who did not shoot the ball takes it out, i.e., "loser takes out".

In the embodiment of FIGS. 6–8, when the ball enters the opening 86 or 88, it can either fall out through the same opening 86 or 88, pass through the passage 92 and fall out through the center or return opening 90 or pass entirely through the passage 92 and fall out through the opposite opening 86 or 88. A regular "shot" that goes into your basket 84*a*, 84*b* and comes out through the center or return opening 90 is worth 2 points.

An extra point can be awarded for a shot that goes into a player's basket (i.e., opening 86 or 88) and comes out of the member 84 through the opposite basket (i.e., opening 88 or 86), i.e., one which passes entirely through the passage 92. This is called a "swoosh" and is worth 3 points.

Other point-related rules can also be in effect. For example, it could be agreed to in advance that a "shot" whereby the ball 40 goes into the basket 84*a*, 84*b* without touching a rim defining the opening 86, 88 is worth 3 points. It could also be agreed to in advance that a "shot" whereby the ball 40 goes into the basket 84*a*, 84*b* and through to the other basket 84*b*,84*a* is worth 3 points.

All of the point-related rules described herein can be modified, changed and combined without limitation and the set number of points allotted for each type of basket is not limited to the number disclosed herein.

Players can also be seated, e.g., in a chair or a wheelchair, and still be able to play this game (i.e., without lying down on the mat). All you have to do is stay in your chair (or wheel chair) on the mat with an opponent who is in a chair or not, and play like you normally would. The rules are all the same.

With respect to ending the game, if beginners are playing, the game ends when one of the players has a certain number of baskets more than his or her opponent, such as 5, or reaches a predetermined point score such as 25 or 50 points or more. For advanced players, the game may end when four quarters (for example of 7 minutes each) end. In a beginners game, the winner is the first person to reach 50 points or more. In an advanced game, the person with the most points at the end of the four quarters is the winner.

It is also possible to play a version of the common "HORSE" game of basketball wherein each player moves to a specific location on the floor or floor mat and attempts a shot. If the ball goes in, the other player has to make the same shot or receives a letter "H", "O", "R", "S" and "E" in turn for each missed shot. Shots are taken from different locations. The player who receives all of the letters of the word "HORSE" loses.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A game, comprising:

a ball; and a basket assembly including a pair of basket members, each of said basket members defining a closed top, closed sides and a single opening at a bottom through which said ball is passable and a hollow interior space adjacent and above said opening such that said ball enters into and exits from the interior space only through said opening, said basket members being connected to one another to provide a predetermined spacing between said openings defined thereby, said interior space in each of said basket members being isolated from said interior space in the other of said basket members such that said ball is not passable between said basket members, whereby points are allotted to players based on the number of times said ball is thrown by said players though said openings in said basket members.

2. The game of claim 1, wherein said basket members have inclined walls adjacent said closed top and inclined walls adjacent said opening, said inclined walls defining said closed sides of said basket members.

3. The game of claim 1, further comprising a floor mat arranged below said basket assembly, said floor mat having markings for locating the heads of the players and the bodies of the players relative to said basket assembly.

4. The game of claim 1, further comprising attachment means for attaching said basket assembly to a ceiling or other elevated surface.

5. The game of claim 4, wherein each of said basket members has an upper region, said attachment means being arranged on said upper region of each of said basket members.

6. The game of claim 4, wherein said attachment means comprise hook-and-loop fasteners.

7. The game of claim 1, wherein said basket members each have an inclined outwardly center portion.

8. The game of claim 1, further comprising an elongate connector for connecting said basket members together at the predetermined spacing, one of said basket members being arranged at each end portion of said connector.

9. The game of claim 1, further comprising a connector for connecting said basket members together at the predetermined spacing, said connector being integrally molded with said basket members.

10. The game of claim 1, wherein said basket members each have a substantially cylindrical upper wall and an inclined lower wall terminating in said opening, said upper and lower walls defining said closed sides of said basket members.

11. An apparatus for a game to be played with a ball, comprising:

a basket assembly defining at least first and second openings at a bottom thereof receivable of the ball, said basket assembly defining an interior space adjacent and above said first and second openings such that the ball enters into the interior space of said basket assembly when passing in an upward direction through said first and second openings;

a mounting member connected to said basket assembly; and attachment means arranged on said mounting member for attaching said mounting member to a ceiling or other elevated surface.

12. The apparatus of claim 11, wherein said basket assembly comprises a unitary basket member defining said first and second openings and the interior space of said basket assembly, said mounting member being connected to said basket member.

13. An apparatus for a game to be played with a ball, comprising:

a unitary basket member defining first and second openings at a bottom thereof receivable of the ball, said basket member defining an interior space adjacent and above said first and second openings such that the ball enters into the interior space of said basket member when passing in an upward direction through said first and second openings, said first opening being arranged at one end portion of said basket member such that a portion of said basket member adjacent said first opening constitutes a first basket and said second opening being arranged at an opposite end portion of said basket member such that a portion of said basket member adjacent said second opening constitutes a second basket, said basket member including a passage connecting said first and second openings and a third opening in communication with said passage and enabling removal of the ball from the interior space of said basket assembly, said third opening being arranged between said first and second openings.

14. The apparatus of claim 13, wherein said basket member has a generally U-shape.

15. An apparatus for a game to be played with a ball, comprising:

a basket assembly defining at least first and second openings at a bottom thereof receivable of the ball and a hollow interior space adjacent and above each of said first and second openings such that the ball enters into the interior space above said first and second openings when passing in an upward direction through said first and second openings, respectively; and attachment means arranged on said basket assembly for attaching said basket assembly to a ceiling or other elevated surface.

16. The apparatus of claim 15, wherein said basket assembly includes first and second basket members, said first and second basket members defining said first and second openings, respectively, at a bottom thereof receivable of the ball, each of said basket members having an upper region, said attachment means being arranged on said upper region of each of said basket members.

17. The apparatus of claim 15, wherein said attachment means are arranged on an upper surface of said basket assembly.

18. A game, comprising:

a ball;

a basket assembly including a pair of basket members, each of said basket members defining a closed top, closed sides and a single opening at a bottom through which said ball is passable and a hollow interior space adjacent and above said opening such that said ball enters into and exits from the interior space only through said opening, said basket members being connected to one another to provide a predetermined spacing between said openings defined thereby; and mounting means arranged on each of said basket members for mounting said basket assembly to a ceiling or other elevated surface.

19. The apparatus of claim 15, wherein said basket assembly includes a single basket member, said first opening being arranged at one end portion of said basket member such that a portion of said basket member adjacent said first opening constitutes a first basket and said second opening being arranged at an opposite end portion of said basket member such that a portion of said basket member adjacent said second opening constitutes a second basket, said basket member including a passage connecting said first and second openings, said attachment means being arranged on said basket member.

20. A method for playing the game of claim 1, comprising:

mounting the basket assembly to a ceiling or other elevated surface;

positioning at least one player in a horizontal, lying down position face up below the basket assembly;

providing the ball to the at least one player to be thrown upward when the player is lying down toward a respective one of the openings; and allotting points to each player when the ball enters into the respective opening.

21. The method of claim 20, wherein the step of positioning the at least one player comprises the step of placing a floor mat having markings for locating the head and body of the at least one player relative to the basket assembly.

22. The method of claim 20, wherein the step of positioning the at least one player comprises the step of positioning two players head-to-head in close proximity to or in contact with one another.

23. The method of claim 20, wherein the step of allotting points to the player comprises allotting points to the other player when the ball is thrown by the player and enters into the respective opening of the other player.

24. The method of claim 20, wherein the step of allotting points to the player comprises the step of allotting different points to the player depending on contact between the ball and a rim defining the respective opening upon passage of the ball through the respective opening.

25. The method of claim 20, further comprising:

providing a pair of basket members each defining one of the openings in the basket assembly; and connecting the basket members together to form the basket assembly.

26. The method of claim 20, wherein the basket assembly includes a unitary basket member defining the openings, further comprising providing a passage in the basket member between the openings, the step of allotting points to each player comprising the step of allotting extra points when the ball enters into one opening, passes through the passage and exits through the opposite opening.

* * * * *